United States Patent [19]

Branovich et al.

[11] Patent Number: 4,808,137

[45] Date of Patent: Feb. 28, 1989

[54] METHOD OF MAKING A CATHODE FROM TUNGSTEN AND IRIDIUM POWDERS USING A BARIUMALUMINOIRIDIATE AS THE IMPREGNANT

[75] Inventors: Louis E. Branovich, Howell Township, Monmouth Co.; Gerard L. Freeman, Freehold Township, Monmouth Co.; Bernard Smith, Ocean, all of N.J.

[73] Assignee: The United States of America as represented by the Secretary of the Army, Washington, D.C.

[21] Appl. No.: 200,219

[22] Filed: May 31, 1988

[51] Int. Cl.[4] ..... H01J 9/04

[52] U.S. Cl. ..... 445/50

[58] Field of Search ..... 445/50, 51; 313/346 DC

[56] References Cited

U.S. PATENT DOCUMENTS

| | | | |
|---|---|---|---|
| 3,176,180 | 3/1965 | Affleck, III | 445/50 X |
| 4,165,473 | 8/1979 | Falce | 313/346 DC X |
| 4,708,681 | 11/1987 | Branovich et al. | 445/50 |
| 4,734,073 | 3/1988 | Smith et al. | 445/50 |
| 4,735,591 | 4/1988 | Branovich et al. | 445/50 |

*Primary Examiner*—Kenneth J. Ramsey

*Attorney, Agent, or Firm*—Sheldon Kanars; Roy E. Gordon

[57] ABSTRACT

A long life high current density cathode is made from a mixture of tungsten and iridium powders using a bariumaluminoiridiate as the impregnant.

8 Claims, No Drawings

METHOD OF MAKING A CATHODE FROM TUNGSTEN AND IRIDIUM POWDERS USING A BARIUMALUMINOIRIDIATE AS THE IMPREGNANT

The invention described herein may be manufactured, used and licensed by or for the Government for governmental purposes with the payment to us of any royalty thereon.

This invention relates in general to a method of making a long life high current density cathode and in particular, to a method of making such a cathode from a mixture of tungsten and iridium powders using a bariumaluminoiridiate as the impregnant.

BACKGROUND OF THE INVENTION

U.S. Pat. No. 4,735,591 issued Apr. 5, 1988 discloses and claims a method of making a long life high current density cathode from tungsten and iridium powders using a barium iridiate as the impregnant. More particularly, according to that patent, a mixture of tungsten and iridium powders is processed with an activator into a porous billet and the porous billet then impregnated with a barium iridiate such as Ba Ir O or Ba Ir O in a dry hydrogen furnace at a temperature at which the impregnant melts. Though the cathode prepared by the method of U.S. Pat. No. 4,735,591 exhibits an improved operating life, the method of the patent is not entirely satisfactory in that the barium iridiate impregnant is difficult to prepare in the pure state. This is because the iridium oxide, $Ir_2O_3$ vaporizes off before the barium oxide, BaO can form.

That is, in preparing the barium iridiate impregnant, one must first heat barium carbonate, $BaCO_3$ to 1450° C. to convert the barium carbonate to the oxide according to the reaction:

$$BaCO_3 \rightarrow BaO + CO_2$$

One must be careful to remove the BaO from the furnace and place it immediately into an inert atmosphere since BaO reacts with $CO_2$ and $H_2O$ from the air to form barium carbonate and barium hydroxide according to the reactions:

$$BaO + CO_2 \rightarrow BaCO_2 \text{ and}$$

$$BaO + H_2O \rightarrow Ba(OH)_2$$

As the barium oxide is being weighed, the latter two chemical reactions occur, thus diminishing the amount of available BaO. The $Ir_2O_3$ is mixed into the BaO in a molar ratio of 3BaO/1Ir, and the material is then placed into a hydrogen furnace.

In summary, one of the disadvantages in the forming of the barium iridiate impregnant is the competition of the carbon dioxide and water from the atmosphere to form barium carbonate and barium hydroxide. Another disadvantage is that $Ir_2O_3$ loses oxygen at 400° C. which tends to push the sample out of the impregnation cup. A third disadvantage is that the residual barium carbonate and barium hydroxide formed in the reaction must be heated to 1450° C. to convert the barium carbonate and barium hydroxide into the barium oxide again.

SUMMARY OF THE INVENTION

The general object of this invention is to provide long life high current density cathodes at lower temperatures. A more particular object of the invention is to provide a method of making such a cathode that will have microwave and millimeter wave applications. A still further object of the invention is to provide such a method that will overcome the disadvantages of the method disclosed and claimed in U.S. Pat. No. 4,735,591.

It has now been found that the aforementioned objects can be attained by using bariumaluminoiridiate as the impregnant.

More particularly, the bariumaluminoiridiate impregnant is obtained by initially reacting barium carbonate with aluminum oxide and then reacting that product with iridium in an atmosphere such as hydrogen in which the iridium metal can not be oxidized and vaporized off.

The bariumaluminoiridiate impregnant, $5BaO/2Ir/1Al_2O_3$ is prepared by first mixing 5 moles of barium carbonate, $BaCO_2$ with one mole of aluminum oxide, $Al_2O_3$ and then ball milling the mixture for two to three hours minimum. The 5:1 molar mix is then placed into an air furnace for two hours at about 1450° C. The reaction is:

$$5BaO + 1Al_2O_3 \rightarrow Ba_4Al_2O_1 + BaO$$

The $Ba_4Al_2O_1 + BaO$ is then mixed with 2 moles of iridium. The melting point of the resulting $5BaO/2Ir/Al_2O_3$ is about 1470° C. to 1500° C. The bariumaluminoiridiate impregnant $5BaO/2Ir/Al_2O_3$ is now ready to impregnate a tungsten-iridium porous billet.

An advantage in the aforementioned method of forming the bariumaluminoiridiate impregnant $5BaO/2Ir/Al_2O_3$ is that no gases such as oxygen are evolved to create a "gush" to push the sample from the impregnation cup. Moreover, the BaO is tied up with the aluminate and cannot react with the $CO_2$ or $H_2O$ in the air to form carbonate or hydroxide. Then too, the iridium is added as a metal only after the aluminate has been formed. This prevents the oxide formation of iridium until the $Ba_1Al_2O_1$ decomposes to form the BaO which then forms the bariumaluminoiridiate without evolution of gas.

DESCRIPTION OF THE PREFERRED EMBODIMENT

A long life, high current density cathode is made in the following manner. Tungsten and iridium powders are mixed in a weight ratio of about 65 weight percent tungsten to about 34 weight percent iridium. 1 percent by weight of zirconium hydride activator is added to the mixture and the mixture ball milled for about 8 hours. The ball milled mixture is then pressed into a billet at about 48,000 psi in a die and the billet then sintered at 1800° C. for thirty minutes in dry hydrogen of less than −100 dewpoint. The billet is then backfilled with copper in dry hydrogen at about 1500° C., the billet machined to the desired geometry, and the copper then removed by etching in nitric acid. The porous billet is then thoroughly rinsed in deionized water, methanol and then dried. The billet is then hydrogen fired at about 1400° C. for about 15 minutes. The billet impregnant $5BaO/2Ir/Al_2O_3$ is then prepared by reacting barium carbonate with aluminum oxide to form barium aluminate and then reacting that product with iridium in an atmosphere such as hydrogen in which the iridium metal can not be oxidized and vaporized off.

The billet is then impregnated with the bariumaluminoiridiate $5BaO/2Ir/Al_2O_3$ by firing the billet in a hydrogen furnace at about 1475° C. for about two minutes. The billet is removed from the furnace after the furnace is cooled and loose particles of impregnant are removed from the billet using a jewelers lathe and fine alumina cloth.

The impregnated billet is then placed in a cathode environment, and initial emission studies indicate that lower operating temperatures are obtained and the life of the cathode is extended.

In the foregoing embodiment, other molar ratios of $BaO/Ir/Al_2O_3$ can be used such as 4:1:1 and 6:2:2 molar ratios.

The $BaO/Ir/Al_2O_3$ molar mixtures when impregnated into a tungsten billet rather than a tungsten-iridium billet also yield desirable current densities.

The cathode operation is similar to other cathode operations. That is, it is heated in vacuum, and a chemical reaction takes place and barium atoms are released which coat the cathode surface.

In the method of the invention, a small amount of an activator as for example, zirconium hydride is included in the billet. The activator enhances the generation of barium atoms at the cathode operating temperature.

We wish it to be understood that we do not desire to be limited to the exact details of construction as described for obvious modifications will occur to a person skilled in the art.

What is claimed is:

1. Method of making a long life high current density cathode suitable for operation in microwave devices from tungsten and iridium powders using a bariumaluminoiridiate as the impregnant, including the steps of:

(A) mixing the tungsten and iridium powders,
(B) adding about 2 percent by weight of an activator to the mixture,
(C) ball milling the mixture for about 8 hours,
(D) pressing the ball milled mixture into a billet at about 48,000 psi in a die,
(E) sintering the billet at about 1800° C. for about thirty minutes in dry hydrogen of less than −100 dewpoint,
(F) back filling the billet with copper in dry hydrogen at about 1500° C.,
(G) machining the billet to the desired geometry,
(H) removing the copper by etching in nitric acid,
(I) thoroughly rinsing in deionized water, methanol and then drying,
(J) firing the billet in dry hydrogen at about 1400° C. for about 15 minutes,
(K) impregnating the billet with bariumaluminoiridiate by firing the billet in a dry hydrogen furnace at a temperature at which the impregnant melts for about two minutes,
(L) removing the billet from the furnace after the furnace is cooled, and
(M) removing any loose pieces of impregnant from the billet.

2. Method of making a long life high current density cathode according to claim 1, wherein in Step (K), the barium aluminoiridiate is attained by initially reacting barium carbonate with aluminum oxide to form barium aluminate and then reacting that product with iridium in an atmosphere such as hydrogen in which the iridium metal cannot be oxidized and vaporized off.

3. Method of making a long life high current density cathode according to claim 1 wherein in Step (B), the activator is about 1 weight percent zirconium hydride.

4. Method of making a long life high current density cathode according to claim 1 wherein in Step (K) the bariumaluminoiridiate is selected from the group consisting of $5BaO/2Ir/Al_2O_3$, $4BaO/Ir/Al_2O_3$ and $6BaO/2Ir/2Al_2O_3$.

5. Method of making a long life high current density cathode according to claim 1 wherein in Step (K) the bariumaluminoiridiate is $5BaO/2Ir/Al_2O_3$.

6. Method of making a long life high current density cathode according to claim 1 wherein in Step (K) the bariumaluminoiridiate is $4BaO/2Ir/Al_2O_3$.

7. Method of making a long life high current density cathode according to claim 1 wherein in Step (K) the bariumaluminoiridiate is $6BaO/2Ir/2Al_2O_3$.

8. Method of making a long life high current density cathode suitable for operation in microwave devices from tungsten and iridium powders using the bariumaluminoiridiate $5BaO/2Ir/Al_2O_3$ as the impregnant, said method including the steps of:

(A) mixing the tungsten and iridium powders in the weight ratio of about 65 weight percent tungsten to about 34 weight percent iridium,
(B) adding about 1 percent by weight of zirconium hydride to the mixture,
(C) ball milling the mixture for about 8 hours,
(D) pressing the ball milled mixture into a billet at about 48,000 psi in a die.
(E) sintering the billet at about 1800° C. for about thirty minutes in dry hydrogen of less than −100 dewpoint,
(F) back filling the billet with copper in dry hydrogen at about 1150° C.,
(G) machining the billet to the desired geometry,
(H) removing the copper by etching in nitric acid,
(I) thoroughly rinsing in deionized water, methanol and then drying,
(J) firing the billet in dry hydrogen at about 1400° C. for about 15 minutes,
(K) impregnating the billet with the bariumaluminoiridiate $5BaO/2Ir/Al_2O_3$ by firing the billet in a dry hydrogen furnace at about 1475° C. for about two minutes, and wherein the bariumaluminoiridiate impregnant is obtained by initially reacting barium carbonate with aluminum oxide to form barium aluminate and then reacting that product with iridium in an atmosphere such as hydrogen in which the iridium metal can not be oxidized or vaporized.
(L) removing the billet from the furnace after the furnace is cooled, and
(M) removing any loose pieces of impregnant from the billet.

* * * * *